US005310375A

United States Patent [19]

Kanauchi

[11] Patent Number: 5,310,375

[45] Date of Patent: May 10, 1994

[54] SMALL DECORATION EQUIPPED WITH SPRING-OPERATED MOVABLE DECORATIVE ELEMENT

[75] Inventor: Shigeru Kanauchi, Yachiyo, Japan

[73] Assignee: Takara, Co. Ltd., Tokyo, Japan

[21] Appl. No.: 62,991

[22] Filed: May 18, 1993

[30] Foreign Application Priority Data

Nov. 30, 1992 [JP] Japan ..... 4-088100[U]

[51] Int. Cl.[5] ..... A63H 33/00; A63H 13/16; A63H 13/00; G09F 19/08

[52] U.S. Cl. ..... 446/71; 446/310; 446/358; 472/6; 185/39; 40/411

[58] Field of Search ..... 40/411; 185/39; 472/6; 84/94, 94.1, 95, 95.1; 446/71, 72, 73, 76, 80, 81, 236, 246, 266, 308, 309, 310, 311, 330, 331, 352, 358, 366, 368

[56] References Cited

U.S. PATENT DOCUMENTS

| | | | |
|---|---|---|---|
| 2,544,594 | 3/1951 | Goldfarb | 446/72 X |
| 2,958,144 | 11/1960 | Stranges et al. | 446/236 X |
| 2,961,794 | 11/1960 | Sachs et al. | 40/411 X |
| 3,100,365 | 8/1963 | Stalder | 446/236 |
| 3,279,793 | 10/1966 | Lakin | 472/6 |
| 3,296,735 | 1/1967 | Djedda | 446/72 |
| 3,570,174 | 3/1971 | Lemelson | 446/309 X |
| 4,575,348 | 3/1986 | Wiggs et al. | 446/487 X |
| 4,643,692 | 2/1987 | Magers | 446/236 X |
| 4,757,986 | 7/1988 | Hwang et al. | 472/6 |
| 5,226,845 | 7/1993 | Wu | 446/358 X |

FOREIGN PATENT DOCUMENTS

| | | | |
|---|---|---|---|
| 555970 | 4/1957 | Belgium | 446/297 |
| 518928 | 3/1955 | Italy | 84/95.1 |
| 294804 | 2/1954 | Switzerland | 84/95.1 |
| 311432 | 9/1928 | United Kingdom | 185/39 |
| 325196 | 7/1929 | United Kingdom | 185/39 |
| 2189710 | 11/1987 | United Kingdom | 446/310 |

*Primary Examiner*—David N. Muir
*Attorney, Agent, or Firm*—Price, Gess & Ubell

[57] ABSTRACT

A small decoration capable of exhibiting play characteristics sufficient to provide a key ring with unexpectedness. The small decoration includes a container provided with a key ring mounting section. In the container is arranged a spring drive unit including a drive mechanism which includes a plurality of gears driven by a spiral spring. The drive mechanism also includes two gear shafts arranged so as to vertically project from the spring drive unit. One of the gear shafts is mounted with a decorative element such as a doll and the other gear shaft is mounted with a spring winding-up element. The spring winding-up element is adapted to wind up the spiral spring in association with closing of a lid member pivotally connected to the container and be returned to the original state while unwinding the spiral spring to actuate the decorative element when the lid member is open.

10 Claims, 3 Drawing Sheets

SMALL DECORATION EQUIPPED WITH SPRING-OPERATED MOVABLE DECORATIVE ELEMENT

BACKGROUND OF THE INVENTION

This invention relates to a small decoration adapted to be used while being mounted on personal belongings such as, for example, a key ring or the like, and more particularly to a small decoration equipped with a spring-operated movable decorative element constructed so as to exhibit play characteristics.

A key holder of one type which is one example of personal belongings generally includes a key ring threaded through a key to hold it thereon and a decorative element mounted on the key ring. The decorative element may include a plate made of a synthetic resin material, a doll, or the like. A key holder of another type which is conventionally known in the art is formed into a shape like a change purse and is provided with a key holding fitting adapted to hold a plurality of keys thereon.

Unfortunately, the conventional personal belongings including such a key ring as described above are not constructed so as to exhibit play characteristics, to thereby fail to give a user or viewer pleasure.

SUMMARY OF THE INVENTION

The present invention has been made in view of the foregoing disadvantage of the prior art.

Accordingly, it is an object of the present invention to provide a small decoration which is capable of exhibiting unexpectedness sufficient to give a user visual pleasure.

It is another object of the present invention to provide a small decoration which is capable of being attached to personal belongings, to thereby provide the personal belongings with decorative characteristics.

In accordance with the present invention, a small decoration equipped with a spring-operated movable decorative element is provided. The small decoration comprises a container provided with a mounting section through which the small decoration is to be attached to an article, a lid member movably connected to the container, and a spring drive unit arranged in the container and including a drive mechanism which includes a spring and a plurality of gears driven by the spring. The drive mechanism includes two gear shafts arranged so as to project from the spring drive unit. The small decoration further comprises a decorative element mounted on one of the gear shafts and a spring winding-up means mounted on the other of the gear shafts. The spring winding-up means is operatively connected to the lid member so as to wind up the spring in association with closing of the lid member and be returned to the original state while permitting unwinding of the spring to actuate the decorative element when the lid member is open.

The small decoration of the present invention constructed as described above may be effectively applied to personal belongings such as a key ring or the like. For example, when it is applied to a key ring for a key of a car, it may give a user or viewer visual pleasure after a key held on the key ring is fitted to a lock of a car. This may be accomplished by winding up the spring of the spring drive unit through the winding-up means and then actuating the decorative element such as a doll mounted on the gear shaft of the drive mechanism by elastic force due to unwinding of the spring. Thus, the small decoration of the present invention is capable of serving as a toy as well as a decoration, to thereby give a user or viewer unexpectedness.

Also, the small decoration of the present invention, as described above, is so constructed that the spring winding-up means is operatively connected to the lid member so as to wind up the spring in association with closing of the lid member and be returned to the original state while permitting unwinding of the spring to actuate the decorative element when the lid member is open. Such construction permits winding-up of the spring to be carried out by one-touch operation of merely closing the lid member and permits the lid member to protect the decorative element when it is not required to enjoy a viewer.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Figure 1:
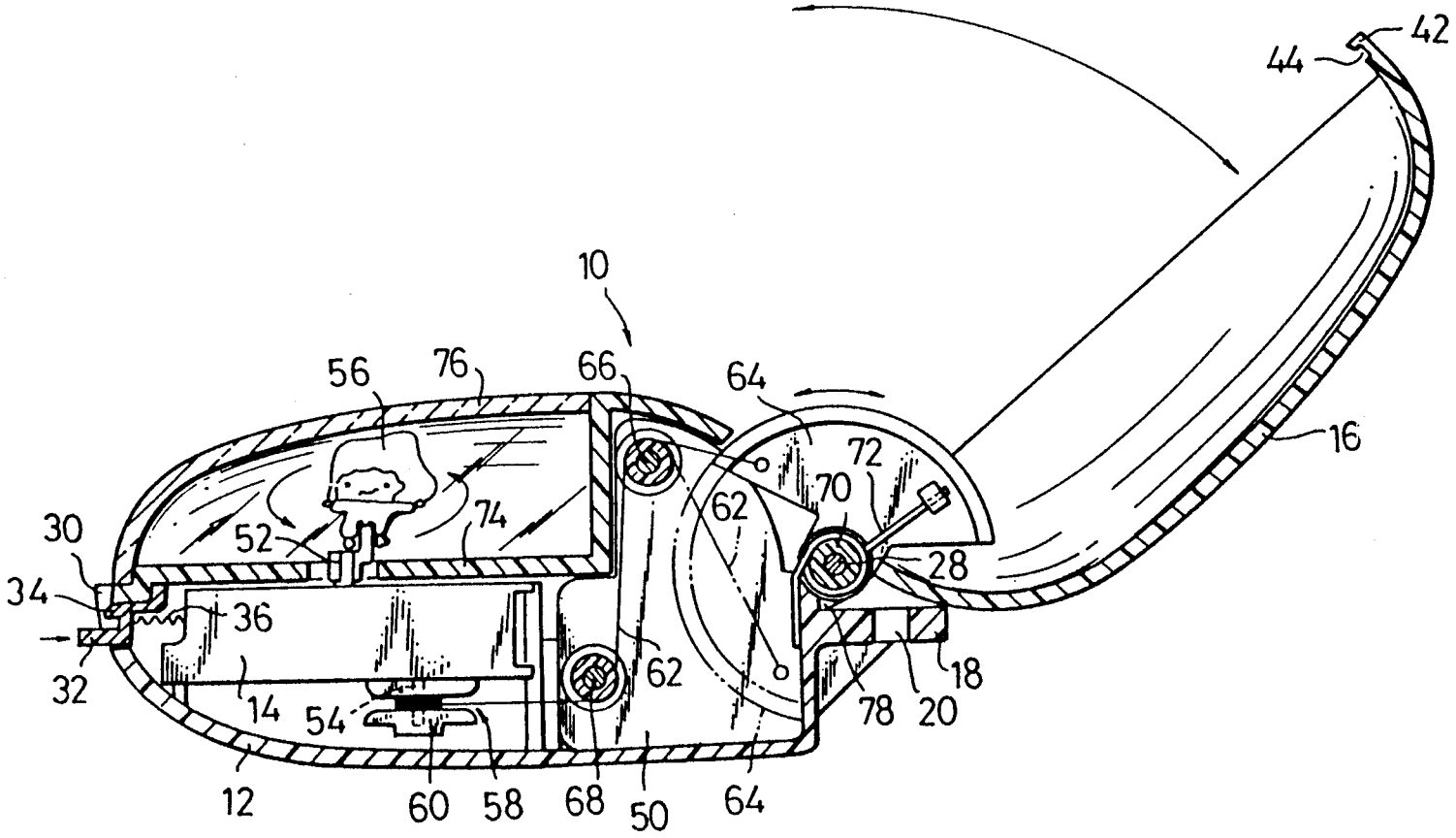
FIG. 1 is a vertical sectional view showing an internal structure of an embodiment of a small decoration according to the present invention, which is applied to a key ring and in which a lid member is kept open.

Now, a small decoration according to the present invention will be described with reference to the accompanying drawings.

FIGS. 1 to 4 illustrate an embodiment of a small decoration equipped with a spring-operated movable decorative element according to the present invention, wherein reference numeral 10 generally designates a small decoration of the illustrated embodiment, which is applied to a key ring The small decoration generally includes a container 12, a spring drive unit 14 arranged in the container 12 and including a spiral spring acting as a drive source and a drive mechanism comprising a plurality of gears, and a lid member 16 pivotally mounted on an upper portion of the container 12 for selectively covering the container 12.

Figure 2:
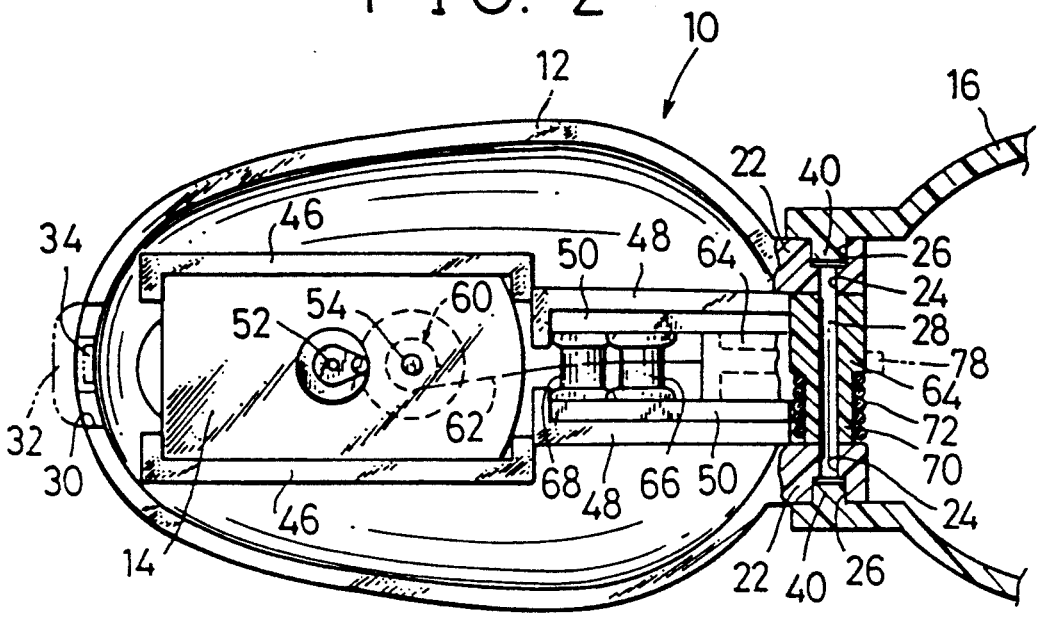
FIG. 2 is a fragmentary plan view showing an essential part of the small decoration shown in FIG. 1, from which a partition members are eliminated for the sake of brevity.
Figure 3:
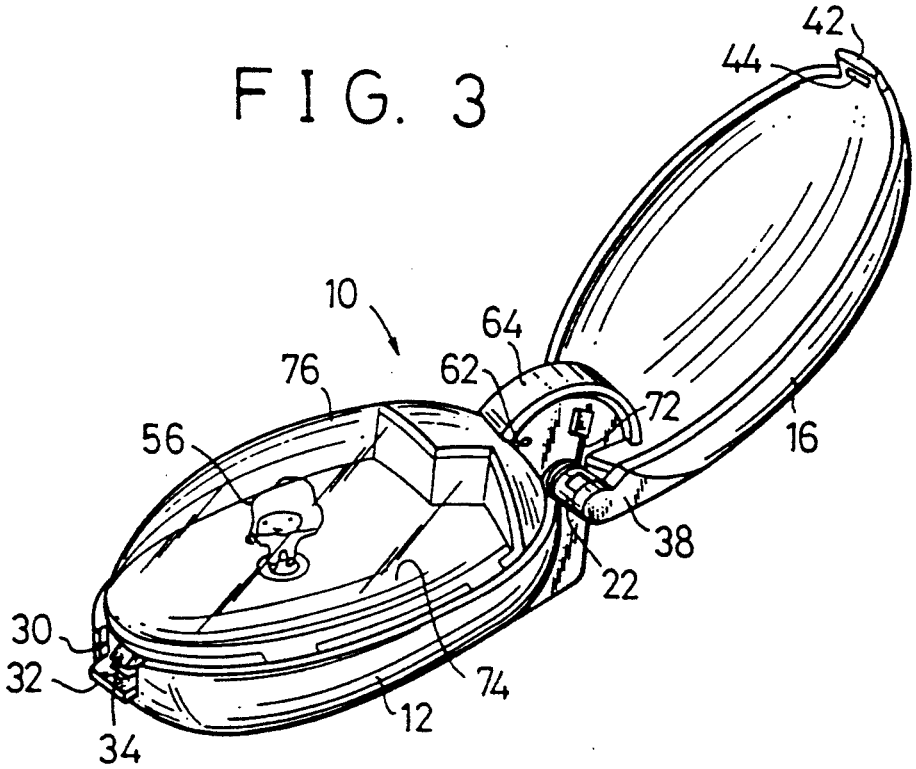
FIG. 3 is a perspective view of the small decoration shown in FIG. 1, in which a lid member is kept open.
Figure 4:
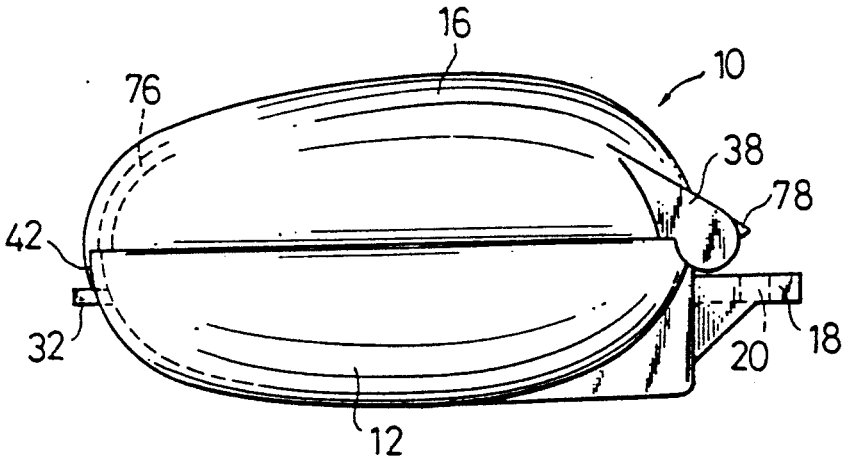
FIG. 4 is a side elevation view of the small decoration shown in FIG. 1, in which a lid member is closed.

The container 12 is formed into a shape like a lower half of an eggshell obtained by horizontally cutting the eggshell into two halves along a longitudinal axis thereof, resulting in being open at a top thereof. The container 12 is provided at a rear portion thereof in a longitudinal direction thereof with a key ring mounting section 18. The key ring mounting section 18 is formed with a through-hole 20 through which a key ring (not shown) is mounted on the mounting section 18. Also, the container 12 is provided at a portion thereof above the key ring mounting section 18 with a bearing section 22 in a manner to be in proximity to the key ring mounting section 18. The bearing section 22, as shown in FIGS. 2 and 3, is formed with a through-hole 24 horizontally extending perpendicular to the longitudinal axis of the container 12. The through-hole 24 is formed at each of both ends thereof into a larger diameter than an intermediate portion thereof, as indicated at reference numeral 26. The through-hole 24 and the larger-diameter ends 26 of the through-hole 24 are formed in a manner to be concentric with each other. The through-hole 24 is securely fitted therein with a shaft member 28. Further, the container 12 is formed at a center of a front portion thereof with a cutout 30, in which a locking member 32 provided on an inner side of the front portion of the container 12 is arranged. The locking member 32 is provided with a locking pawl 34 and arranged in such a manner that a distal end thereof is outwardly projected from the container 12. Also, the locking member 32 is constantly outwardly urged by an elastic member 36.

The lid member 16 is formed into a shape sufficient to permit mating surfaces of the container 12 and lid member 16 to be aligned with each other when the container 12 is covered with the lid member 16. More particularly, the lid member 16 is formed into a shape like an upper half of an eggshell corresponding to the lower half of the eggshell which is the shape of the container 12. Thus, the lower half of the eggshell may be obtained by horizontally cutting the eggshell into two halves along a longitudinal axis thereof, so that the lid member 16 is open at a bottom thereof. The lid member 16 thus formed is provided at a lower portion of a rear end thereof in a longitudinal direction thereof with a pair of arms 38 in a manner to rearwardly outwardly extend therefrom. The arms 38 each are provided on an inner side of a distal end thereof with a projection 40 of a cylindrical shape. The projections 40 are fitted in the larger-diameter ends 26 of the through-holes 24 of the bearing section 22 of the container 12, respectively, so that the lid member 16 may be pivotally connected to the container 12. The lid member 16 is provided on a lower surface of a front portion thereof in the longitudinal direction thereof with a tongue-like member 42 in a manner to downwardly extend therefrom. The tongue-like element 42 is formed on an inner side thereof with a recess 44 adapted to be engaged with the locking pawl 34 of the locking member 32 provided at the front portion of the container 12.

The container 12 is provided therein with a pair of first walls 46 parallel to each other in a manner to upwardly project from a bottom surface of the container and extend from the front portion of the container 12 to an intermediate portion thereof in the longitudinal direction of the container 12. The above-described spring-drive unit 14 is arranged in the container 12 so as to be positioned between the parallel walls 46 and includes a drive mechanism conventionally known in the art which acts to transmit elastic force of a spiral spring to a plurality of gears. More particularly, the drive mechanism includes a first gear shaft 52 which is arranged so as to upwardly project from an upper surface of the spring drive unit 14 and bent into an L-shape so that an upper end portion thereof is eccentric from a center of rotation of the gear shaft 52. Also, the drive mechanism includes a second gear shaft 54 arranged so as to downwardly project from a lower surface of the drive mechanism 14. The container 12 is provided therein with a pair of second walls 48, which are arranged so as to be parallel to each other and extend from the intermediate portion of the container 12 to the rear portion thereof in the longitudinal direction of the container 12. The walls 48 are mounted on an inner surface thereof with side walls 50, which are arranged opposite to each other.

As shown in FIG. 1, the eccentric upper end of the gear shaft 52 is mounted thereon with a decorative element 56 which is formed into a suitable shape like a doll or the like, whereas the gear shaft 54 is connected thereto a spring wind-up means 58 for winding up a spiral spring (not shown) of the spring drive unit 14. The spring wind-up means 58 is constituted by a string wheel 60 mounted on a portion of the gear shaft 54 of the drive mechanism downwardly projecting from the spring drive unit 14, a string 62 wound at a proximal end portion thereof on the string wheel 60, the lid member 16 pivotally connected to the container 12, and a movable member 64 which is formed into a substantially fan-like shape and of which a central portion 70 is loosely fitted on the shaft member 28 so as to be pivotally supported on the shaft member 28. The string 62 is fixed at a distal end thereof to a distal end of the movable member 64 through two intermediate string wheels 66 and 68 arranged between both side walls 50 in the container 12 so as to be vertically spaced from each other. The movable member 64 is mounted on an outer periphery of the central portion 70 thereof pivotally supported on the shaft member 28 with a spring member 72, which acts to constantly urge the movable member 64 in a direction in which the lid member 16 is open. Also, the movable member 64 is provided on the outer periphery of the central portion 70 thereof with a fin 78 acting as a restriction, which is adapted to be engaged with the container 12 to limit pivotal movement of the movable member 64 within a predetermined range when the spring member 72 moves the movable member 64 together with the lid member 16 in the direction in which the lid member 16 is open. When the lid member 16 is moved against the spring member 16 in order to cover the container 12, resulting in being mated or contacted with the container 12, the recess 44 formed on the inner surface of the tongue-like element 42 provided on the front end of the lid member 16 is engaged with the locking pawl 34 of the locking member 32 provided at the center of the front portion of the container 12, resulting in the container 12 being securely covered with the lid member 16. Whereas when the locking member is inwardly pressed or forced to release the engagement of the locking pawl 34 with the recess 44, the spring member 72 permits the lid member 16 to be open. In the illustrated embodiment, the spring member 72 is arranged for the purpose of urging the movable member 64. Alternatively, the spring member 72 may be arranged between the lid member 16 and the container 12 to urge the lid member 16 directly in the direction of opening of the lid member 16.

Thus, when the lid member 16 is pivotally moved to cover the container 12, the movable member 64 is pressed by the inner surface of the lid member 16. This results in the movable member 64 to be pivotally moved about the shaft member 28 of the bearing section 22, to thereby cause the movable member 64 to be fully received in the container 12 and the string 62 wound on the string wheel 60 to be drawn out therefrom. This causes the string wheel 60 to be rotated to wind up the spiral spring of the spring drive unit 14 through the gear shaft 54.

The container 12 is provided on the open top portion thereof with a partition member 74, which includes a horizontally extending flat front portion and a rear portion upwardly extending from a rear end of the front portion, resulting in cooperating with the container 12 to define a space sufficient to receive the movable member 64 therein. The front portion of the partition member 74 is covered with a transparent dome-like member 76 formed into an outer configuration corresponding to the inner surface of the lid member 16, so that the partition member 74 and dome-like member 76 cooperate with each other to define therebetween a space sufficient to receive the decorative element 56 therein. The gear shaft 52 is arranged so as to upwardly extend via a hole formed through the front portion of the partition member 74, so that the decorative element 56 movably located in the space between the partition member 74 and the transparent dome-like member 76. It is preferable that the partition member 74 may be provided on a surface thereof with a background suitable to the decorative element 56. Also, the decorative element 56 may be movably supported on a support which may be arranged on the partition member 74. Alternatively, it may be supported on the gear shaft 52 through an actuation shaft mounted on the gear shaft. Such arrangement of the decorative element 56 permits it to exhibit composite or complicated motion. The decorative element 56 may be formed in imitation of a pet, a wild animal or the like other than a doll.

Now, the manner of operation of the small decoration of the illustrated embodiment constructed as described above will be described hereinafter.

First, a key may be held on a key ring (not shown) mounted on the key ring mounting section 18 of the container 12. Then, the locking member 32 is inwardly forced to release engagement between the locking pawl 34 of the locking member 32 of the container 12 and the recess 44 of the tongue-like element 42 of the lid member 16, so that the spring member 72 acts to open the lid member 16. This causes the spiral spring of the spring drive unit 14 to be unwound, to thereby generate elastic force, so that the drive mechanism of the spring drive unit 14 comprising a plurality of the gears is rotated, resulting in the string 62 being wound up on the string wheel 60 mounted on the gear shaft 54 of the spring drive unit 14. Concurrently, the spring member 72 causes the movable member 64 operatively connected to the distal end of the string 62 to be pivotally moved about the shaft member 28 of the lid member 16, so that the movable member 64 is exposed from the container 12. Likewise, the gear shaft 52 of the spring drive unit 14 is caused to be rotated, so that the decorative element 56 mounted on the gear shaft 52 may exhibit rotary motion.

Then, when the lid member 16 is moved to cover the container 12, the movable member 64 is forced by the inner surface of the lid member 16, resulting in being received in the container 12 as indicated at phantom lines in FIG. 1. Concurrently, the movable member 64 pulls the string 62, so that the string wound up on the string wheel 60 is unwound and the spiral spring of the spring drive unit 14 is wound up. The spiral spring is kept wound-up due to engagement of the locking pawl 34 of the locking member 32 of the container 12 with the recess 44 of the lid member 16.

Opening and closing of the lid member 16 with respect to the container 12 are repeated by repeating the above-described procedure.

Thus, the small decoration 10 of the illustrated embodiment not only permits a key (not shown) such as an engine key of a vehicle or the like to be held thereon while being mounted on a key ring (not shown) attached to the key ring mounting section 18, but permits the decorative element 56 formed in imitation of a doll and mounted on the gear shaft 52 of the drive mechanism to exhibit motion by opening the lid member 16 after fitting the key to a lock of a vehicle to unwind the spiral spring of the spiral drive unit 14, resulting in exhibiting play characteristics sufficient to give a viewer or user visual pleasure. Thus, it will be noted that the small decoration of the illustrated embodiment exhibits characteristics of both a key ring and a toy, so that a user may enjoy unexpectedness.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A small decoration equipped with a spring-operated movable decorative element comprising:

a container provided with a mounting section through which the small decoration is to be attached to an article;

lid member movably connected to said container;

a spring drive unit arranged in said container and including a drive mechanism which includes a spring and a plurality of gears driven by said spring;

said drive mechanism including two gear shafts arranged so as to project from said spring drive unit;

a decorative element mounted on one of said gear shafts; and a spring winding-up means mounted on the other of said gear shafts;

said spring winding-up means being operatively connected to said lid member so as to wind up said spring in association with closing of said lid member and be returned to the original state while permitting unwinding of said spring to actuate said decorative element when said lid member is open.

2. A small decoration as defined in claim 1, wherein said lid member is pivotally connected at one end thereof to said container.

3. A small decoration as defined in claim 2, wherein said spring winding-up means comprises a string wheel mounted on said other gear shaft of said drive mechanism, a movable member pivotally supported so as to be concentric with a center of pivotal movement of said lid member, and a string fixed at one end thereof on said movable member and wound at the other end thereof on said other gear shaft.

4. A small decoration as defined in claim 2, further comprising a locking means for securely engaging said lid member with said container;

said locking means being arranged at a position opposite to a position at which said lid member is pivotally connected to said container.

5. A small decoration as defined in claim 3, wherein said movable member is provided with a spring member for urging said movable member in a direction in which said lid member is open.

6. A small decoration as defined in claim 5, wherein said one gear shaft of said drive mechanism has an upper end portion formed eccentric from a center of rotation thereof;

said decorative element being mounted on said upper end portion.

7. A small decoration as defined in claim 6, wherein said container is provided with a partition member for substantially closing an opening of said container and a transparent dome-like member;

said transparent dome-like member cooperating with said partition member to define a space for receiving said decorative element therein.

8. A small decoration as defined in claim 5, wherein said movable member is formed into a substantially fan-like shape and pivotally supported at a center thereof; and said movable member is provided at a portion thereof in proximity to said center with a restriction for limiting movement of said movable member when said lid member is open.

9. A key ring movable decorative display member comprising:

a housing having a movable cover lid;

a transparent cover extending over a portion of the housing;

a support surface extending under the transparent cover and partitioning the housing;

a movable decorative member mounted on the support surface;

a movable propulsion member extending through the support surface to provide propulsion power to the movable decorative member;

a spring-wound motor means mounted in the housing and connected to the movable propulsion member;

a lid member pivotally connected to the housing and also connected to the spring-wound motor means to extend over the transparent cover in a closed configuration and to rotate away from the transparent cover in an open configuration; and means for releasing the lid member from a closed configuration, a movement of the lid member to the closed configuration stores energy in the spring-wound motor and the release of the lid member activates the spring-wound motor means to drive the movable decorative member.

10. The invention of claim 9 further including a resilient member to bias the lid member to an open position.

* * * * *